United States Patent [19]

Yost

[11] Patent Number: 4,827,371

[45] Date of Patent: May 2, 1989

[54] METHOD AND APPARATUS FOR IONIZING GAS WITH POINT OF USE ION FLOW DELIVERY

[75] Inventor: Michael G. Yost, Berkeley, Calif.

[73] Assignee: Ion Systems, Inc., Berkeley, Calif.

[21] Appl. No.: 176,845

[22] Filed: Apr. 4, 1988

[51] Int. Cl.[4] ..... H05F 3/06

[52] U.S. Cl. ..... 361/213; 361/231

[58] Field of Search ..... 361/213, 230, 231

[56] References Cited

U.S. PATENT DOCUMENTS

| | | | |
|---|---|---|---|
| 2,723,349 | 11/1955 | Rulsky | 361/231 |
| 2,785,312 | 3/1957 | Martin, Jr. | 361/231 |
| 2,928,941 | 3/1960 | Hicks et al. | 361/231 |
| 4,542,434 | 9/1985 | Gehlke et al. | 361/231 |

*Primary Examiner*—L. T. Hix
*Assistant Examiner*—D. Rutledge
*Attorney, Agent, or Firm*—Phillips, Moore, Lempio & Finley

[57] ABSTRACT

Potentially damaging electrostatic charges on semiconductor wafers or other objects are suppressed during the manufacturing process by generating ions in a flow of nitrogen or other non-reactive gas and by delivering the ionized flow to the product region through an enclosed flow path. The ions are produced by directing X-rays or other ionizing radiation into a shielded chamber portion of the flow path where flow is relatively slow and a large volume of gas is exposed to the X-rays. The ionized flow is then transmitted to the product region through a relatively narrow tubulation in which flow velocity is higher. Inter-relating of the flow rate and the length and diameter of the delivery tube minimizes ion loss from contact with the tube wall and from charge exchange with each other. The process and apparatus do not generate ozone or metallic particles, which can damage the products, as may occur with prior systems which use high voltage electrodes to ionize the air. The method and apparatus may also be used for other purposes such as air purification.

29 Claims, 6 Drawing Sheets

POWER SUPPLY
HIGH VOLTAGE GENERATOR
PRESSURIZED GAS SUPPLY
FILTER
V
F
11
12
13
14
16
17
18
19
21
22
23
24
25
26
27
28
29
31
32
33
34
36
37
38
39
41
42
46
47
48
49
51
52

METHOD AND APPARATUS FOR IONIZING GAS WITH POINT OF USE ION FLOW DELIVERY

TECHNICAL FIELD

This invention relates to controlling of the ion content of the atmosphere at a predetermined region. More particularly the invention relates to a method and apparatus for maintaining an ionized atmosphere at a predetermined region to suppress electrostatic charge buildup on objects in the region or for other purposes.

BACKGROUND OF INVENTION

Electrically insulative objects and ungrounded metallic objects tend to acquire charges of static electricity which may range up to several thousand volts. Charge accumulation results from several causes such as movement and the accompanying friction, induction and receipt of discharges from other objects or from charged surfaces.

The eventual discharge of accumulations of static electricity can have undesirable effects and in some circumstances can cause severe damage to objects such as certain industrial products. A notable example occurs in the manufacture of miniaturized semiconductor electronic components. Static discharges can destroy the minute conductive paths in integrated circuit wafers, microchips and the like, and have been an important cause of the high rejection rate of such products during the manufacturing process. Static charges also attract and cause adherence of dust particles and other contaminants that can adversely affect the product.

Manufacture of such products is performed in areas termed clean rooms in which elaborate precautions are taken to eliminate potential contaminants and also to suppress electrostatic charge buildup on the products. Maintaining a high level of free ions in the air which surrounds the product is one of the more effective techniques for suppressing such charge buildup. Positive and negative ions of the constituent gases of air are electrostatically attracted to charge accumulations of opposite polarity and then neutralize such accumulations by charge exchange.

The conventional air ionizer for such purposes includes one or more high voltage electrodes which are typically situated several feet away from the objects that are to be protected. The intense electrical field created by the electrode causes a corona discharge and acts to dissociate molecules of the constituent gases of air into charged ions. Ions having a polarity similar to that of the electrode are repelled by the electrode and disburse outwardly towards the products which are to be protected. Electrodes of both polarities are provided or the voltage on a single electrode is periodically reversed in order to generate ions of both polarities. The system must be more or less continuously monitored and adjustments made as needed to assure that the appropriate ratio of positive to negative ions is maintained. An imbalance, which may occur from such causes as unequal electrode erosion, can have the counter-productive effect of imparting charge to the products.

The conventional air ionizing apparatus and procedures are not satisfactorily compatible with recent developments in clean room technology which include more closely controlling the environment of the products. Efforts are being made to reduce the level of particulate contamination in the atmosphere which is adjacent to the product. In some cases these include maintaining the products in isolation boxes, to the extent possible, during processing. The boxes are continuously purged with a flow of very clean inert gas such as nitrogen. Modern clean rooms commonly operate at particulate levels of fewer than 100 particles per cubic foot and some operate at fewer than 10 particles per cubic foot.

High voltage air ionizing apparatus must necessarily be spaced a substantial distance from the products to allow for intermixing of the positive and negative ions which are produced at spaced apart electrodes or at alternating time periods at the same electrode. If the electrodes are too close, the apparatus may itself impart charge to the products. Thus such apparatus cannot be placed inside isolation boxes or the like unless they are of excessive size.

The effective range of the conventional system is undesirably limited under many working conditions. Ions of opposite polarity continually neutralize each other while drifting from the electrode to the products which are to be protected. Ions of either polarity are also electrostatically attracted to walls or other nearby objects and are then neutralized by charge exchange. Thus the ion content in the air falls rapidly as a function of distance from the ionizing electrodes. This problem cannot be cured by locating the high voltage electrodes in close proximity to the products. As previously discussed, that can cause an imparting of static charge to the products rather neutralization of charge.

Further, the conventional high voltage air ionizing apparatus has itself been found to be a source of particulate contamination at levels that can be significant where an extremely clean product environment is needed.

In particular, such apparatus releases metallic particles into the adjacent atmosphere which typically have a size around 300 Angstrom units. This is believed to result from erosion of the high voltage electrodes by the corona discharges which occur at the electrodes. Heat, sputtering and the presence of free radicals in the discharge may be contributing factors. In any case, particle release is a demonstrable occurence which can be minimized by use of special electrode materials but which cannot be entirely eliminated.

A further problem is encountered in that high voltage discharges may convert some atmospheric oxygen into ozone. Ozone is a highly reactive gas which can be very damaging to certain products such as the semiconductor wafers discussed above.

The background of the invention has been herein discussed with reference to the suppression of electrostatic charge accumulations on objects. There are also other reasons why it may be beneficial to provide an ionized atmosphere at a particular region such as, for example, air purification. A high ion content in the air at a particular region acts to remove dust, smoke, pollens and other particulates from the air. The particulates acquire an electrical charge by charge exchange with such ions and are then electrostatically attracted to nearby walls or other surfaces.

The present invention is directed to overcoming one or more problems discussed above.

SUMMARY OF THE INVENTION

In one aspect, the present invention is directed to a method for providing an ionized gas environment at a predetermined region and includes the steps of directing a flow of pressurized gas to the region along an enclosed flow path and ionizing the gas flow by directing ionizing radiation into a predetermined portion of the enclosed flow path at a location which is spaced apart from the predetermined region. Further steps include suppressing the escape of radiation which propagates out of the predetermined portion of the flow path and releasing the ionized gas flow from the enclosed flow path at the region at which the ionized gas environment is being provided.

In another aspect of the method, the flow path is expanded and the flow is slowed at the predetermined portion of the flow path and the flow path is contracted and the gas flow is accelerated at the portion of the flow path which extends from the predetermined portion to the region at which said ionized gas environment is being provided.

Another, preferred, aspect of the method includes the steps of producing ions in the gas flow by directing X-rays into the predetermined portion of the flow path and maintaining the gas flow substantially free of oxygen at least at the predetermined portion of the flow path.

In another aspect, the invention provides a method of suppressing electrostatic charge accumulations by industrial products or the like which are situated at a predetermined region and includes the steps of directing a flow of pressurized gas to the region along an enclosed flow path and ionizing the gas flow by directing ionizing radiation into a predetermined portion of the enclosed flow path at a location which is spaced apart from the product region. Further steps include suppressing the escape of radiation which propagates out of the predetermined portion of the flow path and releasing the ionized gas flow from the enclosed flow path at the product region.

In still another aspect, the invention provides apparatus for providing an ionized gas environment at a predetermined region which apparatus includes a housing having a chamber with inlet and outlet openings, inlet means for transmitting a pressurized gas flow to the inlet opening and a source of gas ionizing radiation positioned to direct radiation into the gas flow within the chamber. The apparatus further includes shielding means for absorbing radiation which leaves the chamber and a flow delivery tubulation for transmitting the gas flow including the ions to the predetermined region, the tubulation having one end connected to the outlet opening of the housing.

In another aspect of the apparatus, the flow delivery tubulation is proportioned to provide a flow path of reduced cross sectional area relative to the cross sectional area of the flow path within the chamber whereby the gas flow travels through the tubulation at a velocity which is higher than the gas flow velocity within the chamber.

In another, preferred, aspect of the invention the source of radiation is an X-ray tube positioned to direct X-rays into the chamber and the gas flow is a flow of nitrogen.

The invention avoids the hereinbefore discussed problems by generating ions within a gas and transmitting a flow of the ionized gas to the point of use along an enclosed flow path. The preferred gas is an oxygen free one such as nitrogen to avoid ozone production. The ions are produced by X-rays or other ionizing radiation rather than by a high voltage electrode to avoid release of metallic contaminants and to enable an inherently balanced production of positive and negative ions. The gas is irradiated within an enlarged region of the flow path. This enhances ion production as a sizable volume of gas is exposed to the radiation and since gas flow velocity is relatively slow within the enlarged region thereby causing each gas atom or molecule to be exposed to radiation for a sizable period of time. Gas flow rate and the proportions of the tubing or the like which deliver ions to the predetermined region are interrelated in a manner which minimizes ion losses within the tubing. Electrostatic charge suppression apparatus embodying the invention can have a compact, simple and economical construction, requires less maintenance than prior equipment and can deliver a high concentration of ions to the interior of one or more isolation boxes or the like.

Other aspects and advantages of the invention will be apparent from the accompanying drawings and the following description of preferred embodiments.

DETAILED DESCRIPTION OF THE PREFERRED EMBODIMENTS

Figure 1:
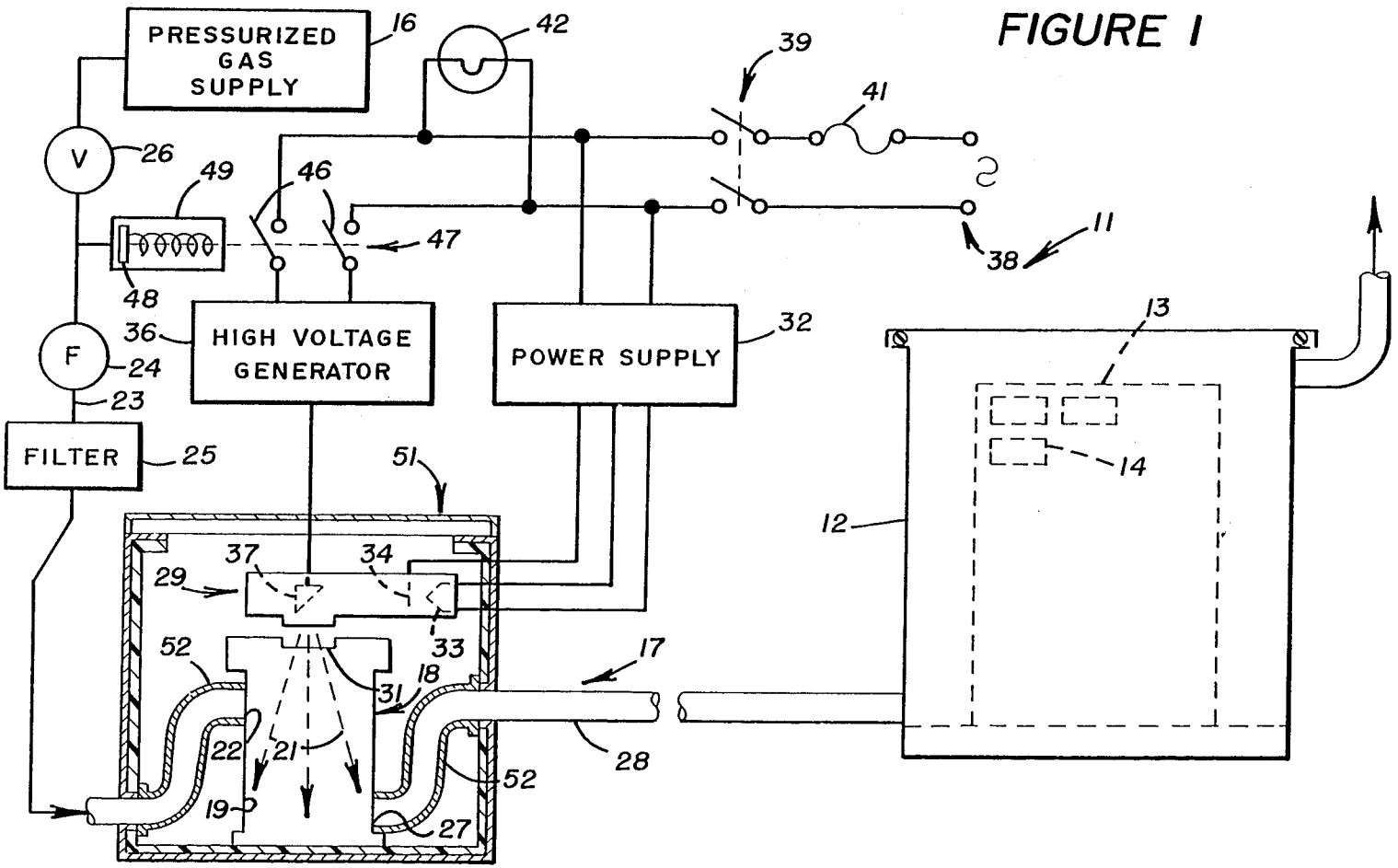
FIG. 1 is a diagrammatic view of apparatus for suppressing electrostatic buildup on industrial products or the like in accordance with a preferred embodiment of the invention.

Referring initially to FIG. 1 of the drawings, apparatus 11, in accordance with this embodiment of the invention, is adapted for suppressing electrostatic charge accumulations and is shown coupled to an isolation box 12 which may be of the known type in which racks 13 supporting arrays of wafers 14 are disposed during certain stages in the manufacture of integrated circuits or other electronic components. It should be recognized that the apparatus 11 can also be used to suppress charge buildup on wafers 14 that are processed at unenclosed work stations and can be used to protect any of a variety of other objects that may be susceptible to damage from static charge accumulations. Similar apparatus 11 may also be used to deliver a flow of ions to a particular region for other purposes such as air purification as one example.

A flow of pressurized gas from a gas supply 16 is transmitted to isolation box 12 through a flow path that includes a housing 18 having an internal chamber 19 into which ionizing radiation 21 is directed to cause ionization of gas molecules. An inlet opening 22 in the wall of housing 18 is communicated with the gas supply 16 through an input conduit 23, a filter 25, a flowmeter 24 and a flow control valve 26. An outlet opening 27 in the wall of housing 18 is communicated with the interior region of isolation box 12 through a flow delivery tubulation 28. Inlet and outlet openings 22 and 27 are preferably at opposite sides of chamber 19, which is cylindrical in this embodiment, and are preferably also spaced apart in the axial direction of the chamber. This lengthens the exposure time of individual gas molecules to radiation 21 creating a greater probability that any particular molecule will be ionized. Filter 25 is situated upstream from the ionizing region of chamber 19 so that it does not cause ion neutralization.

The gas which is used in the ionizing process should be oxygen free and should be a gas or mixture of gases that is relatively non-reactive in general. The gas is also preferably one which exhibits a high susceptibility to ionization when exposed to radiation. Very light gases such as helium for example are not strongly ionized by radiation. Nitrogen exhibits the properties which are desirable for the present purpose and is also a highly practical choice for economical reasons. Most clean rooms are already equipped with a piped-in nitrogen supply for use in purging isolation boxes 12 and other purposes. A number of other gases, such as xenon for example, are also suitable for use in the present process but tend to be more costly.

It may not be necessary to use a non-reactive, oxygen free gas in certain instances where the apparatus 11 is used for purposes that differ from those described above. A flow of air through chamber 19 can be used, for example, in instances where the objective is to remove particulate matter from the air at a particular region.

The radiation source is preferably an X-ray tube 29 positioned to direct X-rays 21 into chamber 19 through a thin window 31 at one end of the chamber. Ultraviolet rays can efficiently ionize some gases although nitrogen is not one of them. Other sources of ionizing radiation, such as a volume of radioactive material, can also be used but the use of such potentially hazardous materials adds complications to the fabrication, handling, operation and disposal of the equipment.

In a preferred form of the invention, X-ray tube 29 is selected or adjusted to provide relatively low energy X-rays in order to minimize shielding requirements. X-rays having an energy of 15 kev, for example, are able to penetrate a thin window 31 of plastic, aluminum or beryllium and then ionize nitrogen efficiently within the chamber 19.

Electrical components for energizing X-ray tube 29 include a low voltage power supply 32 for the filament 33 and control grid 34 of the tube and a high voltage generator 36 for the tube anode 37, which components may be of conventional design. Both power supply 32 and high voltage generator 36 receive input current from utility power line terminals 38 through a control switch 39 for turning the system on and off. A fuse 41, connected between power terminals 38 and control switch 39, opens the circuit if a current overload should occur. An indicator lamp 42 is connected across the pair of conductors 43 that supply operating current to power supply 32 and high voltage generator 36 to provide a visual signal when the control switch 39 is closed and the circuit is energized.

It is preferable that generation of X-rays 21 be stopped at any time that the gas flow control valve 26 is closed. For this purpose the high voltage power supply 36 is connected to the input power conductors 44 through normally open contacts 46 of a pressure operated switch 47 which closes in response to gas pressure at the outlet side of flow control valve 26. The switch 47 may, for example, be of the form having a spring biased piston 48 which is slidable within a casing 49 that is communicated with the outlet of control valve 26 and which shifts to close contacts 46 in response to a predetermined gas pressure. Thus high voltage is applied to X-ray tube anode 37 only when gas flow is occurring although other portions of the circuit remain energized as long as control switch 39 is closed.

The ionizing chamber housing 18 and X-ray tube 29 are disposed within a shielding enclosure 51 which is formed at least in part of X-ray absorbent material in order to prevent escape of radiation from the apparatus. A one millimeter thickness of lead, for example, prevents release of X-rays of 15 kev energy. Sleeves 52 of the shielding material extend from the enclosure 51 towards housing 18 and enclose the end portions of inlet conduit 23 and flow delivery tubulation 28 that are adjacent to the housing. The sleeves 52 have an approximately S-shaped curvature or other convolutions which present an absorbent surface to X-rays that might otherwise escape from enclosure 51 through the openings that receive and transmit gas flow.

Figure 2:
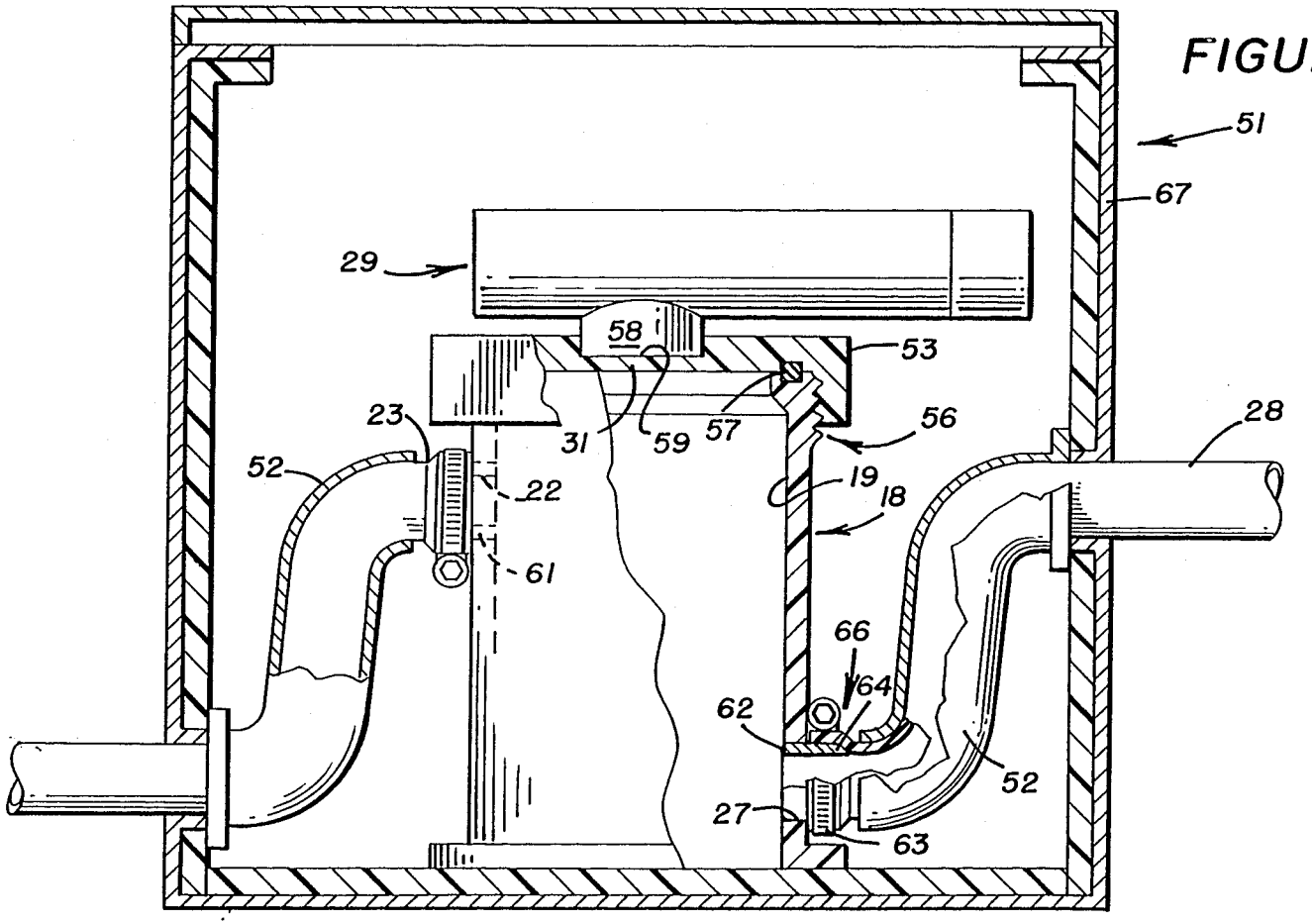
FIG. 2 is a broken out side view illustrating one suitable detailed construction for certain components of the apparatus of FIG. 1.

FIG. 2 depicts the construction of the ionizing chamber housing 18 and shield enclosure 51 of one specific example of the invention in more detail. It should be recognized that these components can have other configurations and dimensions and be formed of other materials subject to certain considerations which will be hereinafter discussed.

The ionizing housing 18 of this particular example is an upright plexiglas cylinder having an internal chamber 19 that is 3 inches in diameter and 4.5 inches in height. The upper end closure of the housing 18 is a plexiglass lid 53 engaged on the body 54 of the housing by screw threads 26 in order to enable access to the chamber 19. An O-ring seal 57 is seated between the body 54 and lid 53.

The protuberant, circular X-ray output window 58 of X-ray tube 29 is seated in a circular well 59 at the center of the outer surface of lid 53. The thin portion of the lid material immediately below well 59 defines the thin window 31 through which X-rays enter the chamber 19 in this example of the invention.

The end of inlet conduit 23, which is a flexible plastic tube in this example, is fitted onto an inlet fitting 61 at the inlet opening 22 near the top of housing 18. At the opposite side of the chamber 19 and at a location near the bottom of the chamber, an outlet fitting 62 at the outlet opening 27 extends into the end of flow delivery tubulation 28 which is also flexible plastic tubing in the present embodiment. Clamps 63 secure conduit 23 and tubulation 28 to fittings 61 and 62 respectively.

Ion neutralization by charge exchange between ions of opposite polarity and by contact with the inner wall of tubulation 28 are reduced if curvatures in the tubulation are avoided to the extend possible and if changes of the diameter of the flow path through the tubulation including outlet fitting 62 are also avoided insofar as is possible. This reduces ion loss from the above described causes by minimizing turbulence in the flow path. For this purpose, outlet fitting 62 preferably has an inside diameter similar to that of the flow delivery tubulation 28. The end portion of the tubulation 28 into which the fitting 62 extends is thus of larger diameter than other portions of the tubulation. In instances where the tubulation 28 is stretchable plastic tubing as in the present embodiment, the enlargement 63 at the end of the tubulation can be formed by simply forcing the fitting 62 into the end of the tubing. This is facilitated by providing a beveled surface 64 at the end of the fitting. The beveled surface 64 also serves to assure that the inside surfaces of fitting 62 and tubulation 28 are continuous around the zone of contact of the two surfaces as the end of the fitting then fills the region immediately inside the tapered transition portion 66 of the tubulation 28 which is formed as the tubing is being forced onto the fitting. This avoids creation of an enlargement in the flow path immediately inside transition portion 66 which would aggravate ion loss by inducing turbulence.

Enclosure 51 in which housing 18 and X-ray tube 29 are contained is rectangular in this example and formed of plastic having a coating 67 of lead, of about one millimeter thickness, on the outside surface. The previously described curved lead sleeves 51, which inhibit escape of X-rays through the inlet conduit 23 and flow delivery tubulation 28, extend to and join the X-ray absorbent coating 67 of the enclosure 51.

Referring again to FIG. 1, the apparatus 11 differs from prior ionizing systems for charge suppression in that ionized gas is delivered to the point of use as an enclosed flow within a conduit such as the tubulation 28. Such piping of free ions, as opposed to the prior practice of simply ionizing the ambient air at a location near the point of use, would at first consideration appear to be an unsuitable procedure. Seemingly, the problem of ion loss from charge exchange with adjacent wall surfaces and with each other would be greatly aggravated. We have found that an adequately high concentration of ions can be maintained in a confined gas flow for distances of up to several feet if certain key parameters of the system are properly interrelated.

In particular, the performance of charge suppressing apparatus 11 essentially similar that described above was evaluated by locating the outlet end of the flow delivery tube 28 eighteen inches away from a charged plate monitor which instrument measures the time, in seconds, required to discharge a 10 inch square plate (67 pf capacitance) from 1000 volts to 100 volts. This measured discharge time is inversely proportional to the ion output from the flow delivery tube 28. Increases in ion output result in lower discharge times.

Testing indicated that the variables with the most pronounced effect on ion output were gas flow rate, tube 28 diameter and the length of tube 28. Other tested variables, which included chamber size and the filament current and anode voltage at X-rays tube 29, had a much smaller effect on performance. Tests using different types of flow delivery tube materials and chamber 19 materials, with other variables held constant, yielded similar results.

A multivariate curve fit model was developed from the test data, using regression techniques, to enable prediction of the discharge time of different particular examples of the apparatus 11 from the three more significant variables, gas flow rate, tube diameter and tube length also taking the gas pressure (in chamber 19) into account. The gas pressure itself depends on the three significant variables so a second curve fit model was developed to predict pressure from those three variables and the predicted pressure is substituted into the discharge time model.

The discharge time model reduces to two equations each with several parameters that were determined by a least-squares fit to the data obtained from the tests of the apparatus 11. The equation for the discharge time is:

$$T=e^{(a+b*D+c*L+d*F+j*P)}$$

where:

T=discharge time (seconds)
D=tube 28 inside diameter (inches)
L=tube 28 length (inches)
F=flow rate (cubic feet per minute)
P=gas pressure (pounds per square inch)
e=2.718

The equation for the pressure is:

$$P=e^{(f+g*D+h*L+i*F)}$$

The curve fit parameters for the above equations are:

| | | |
|---|---|---|
| a = 3.255 | b = 1.108 | c = 0.027 |
| d = −0.315 | j = 0.028 | f = 1.107 |
| g = −6.177 | h = 0.010 | i = 0.398 |

A major advantage of the curve fit model is that it enables examination of the influence of one of the three variables while the others are held constant. It would be very difficult to obtain this information experimentally because of the interaction between the variables.

The fit of the model predictions with the original experimental data provides about a 95% correlation between predicted and observed values. Validity of the model was further established by using the model to predict discharge times for untested values of tube length and diameter and then verifying those values experimentally. The predicted discharge times were within two seconds of the experimental results including predicted discharge times for tube lengths and diameters about double the largest test values that had been used to generate the model. Thus the model accurately extrapolates to values outside the original test range.

Figure 3A:
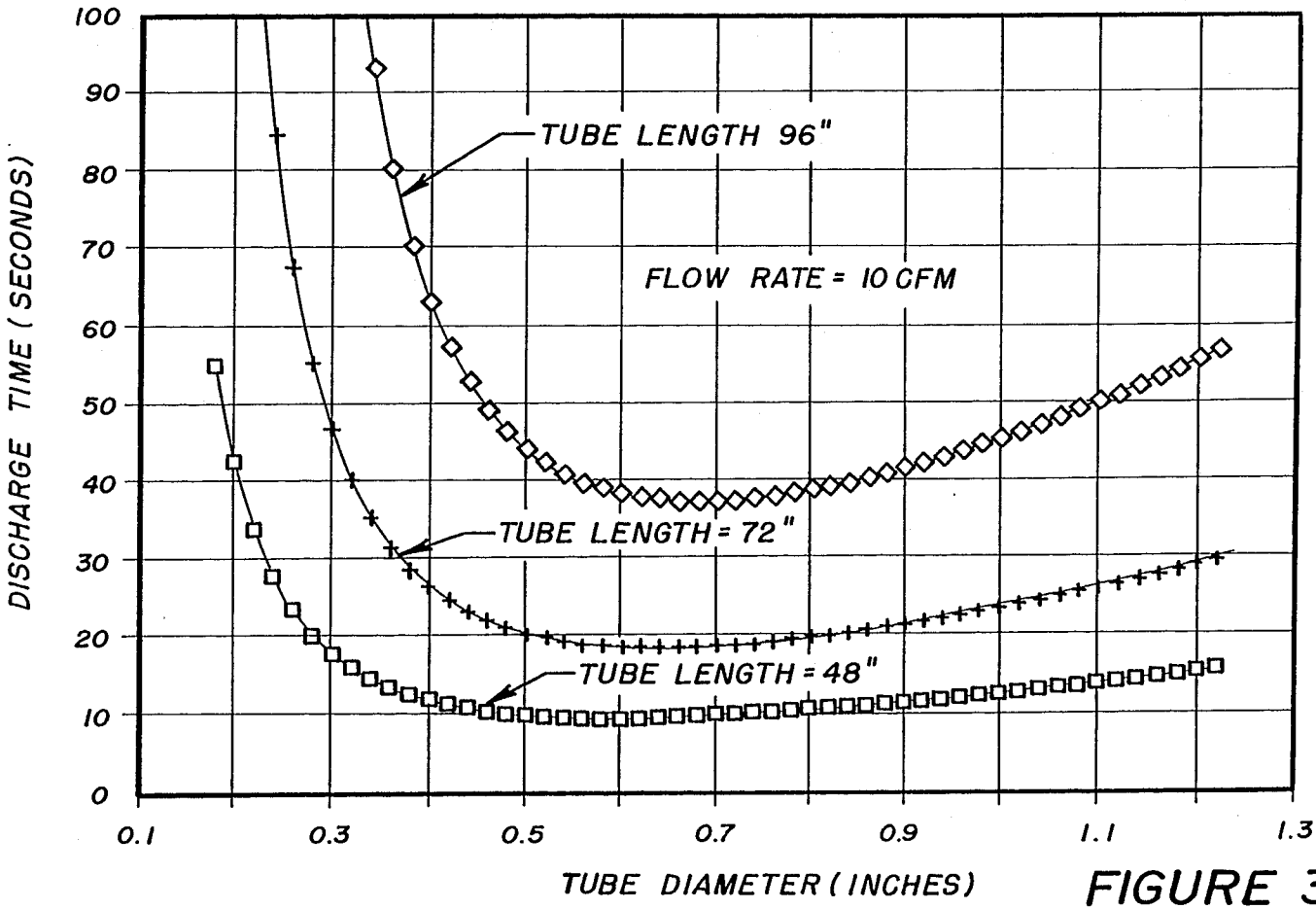
FIGS. 3A, 3B and 3C are graphs depicting the influence of variations of certain key parameters on ion output of apparatus of the type depicted in FIGS. 1 and 2.
Figure 3B:
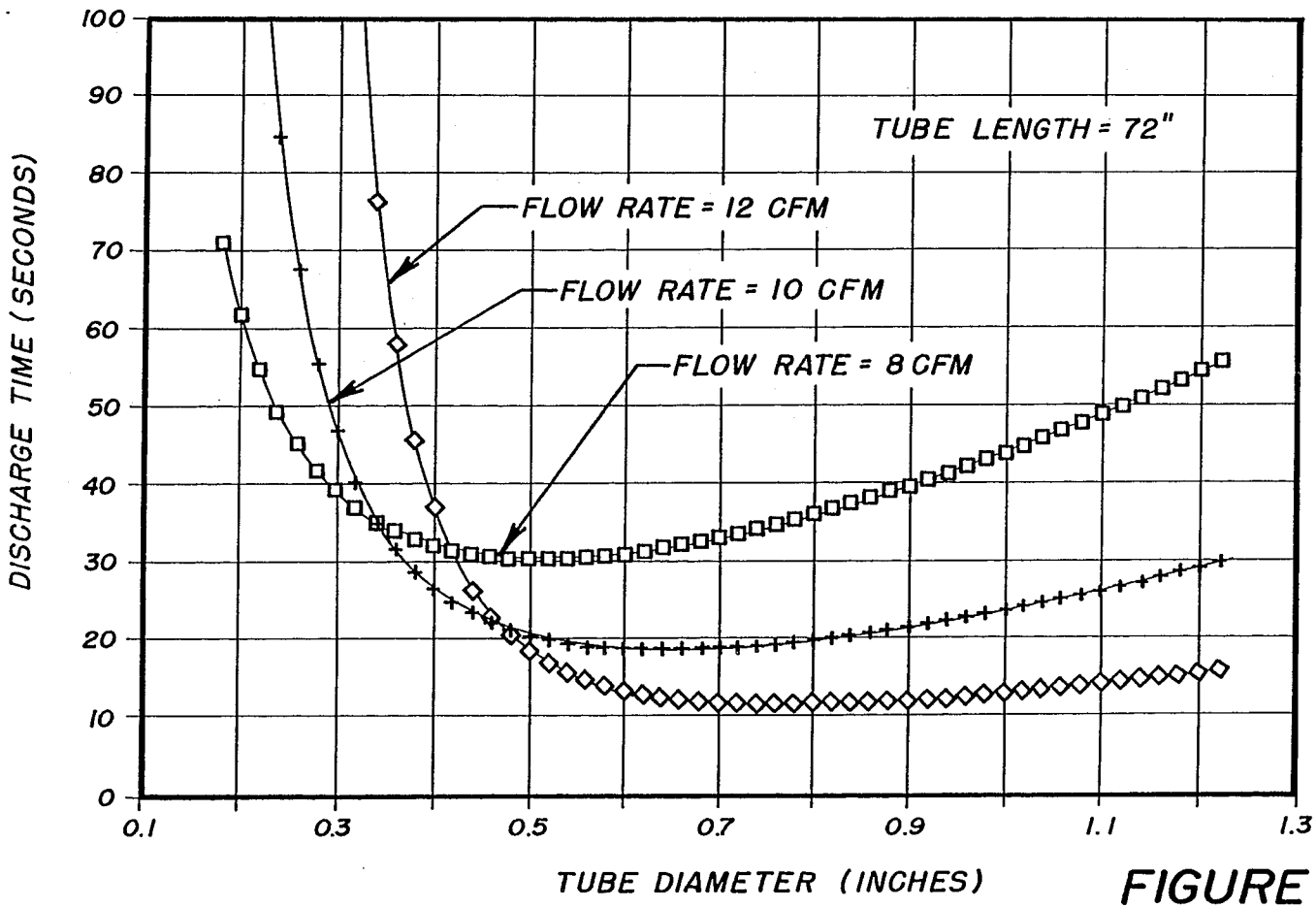
Figure 3C:
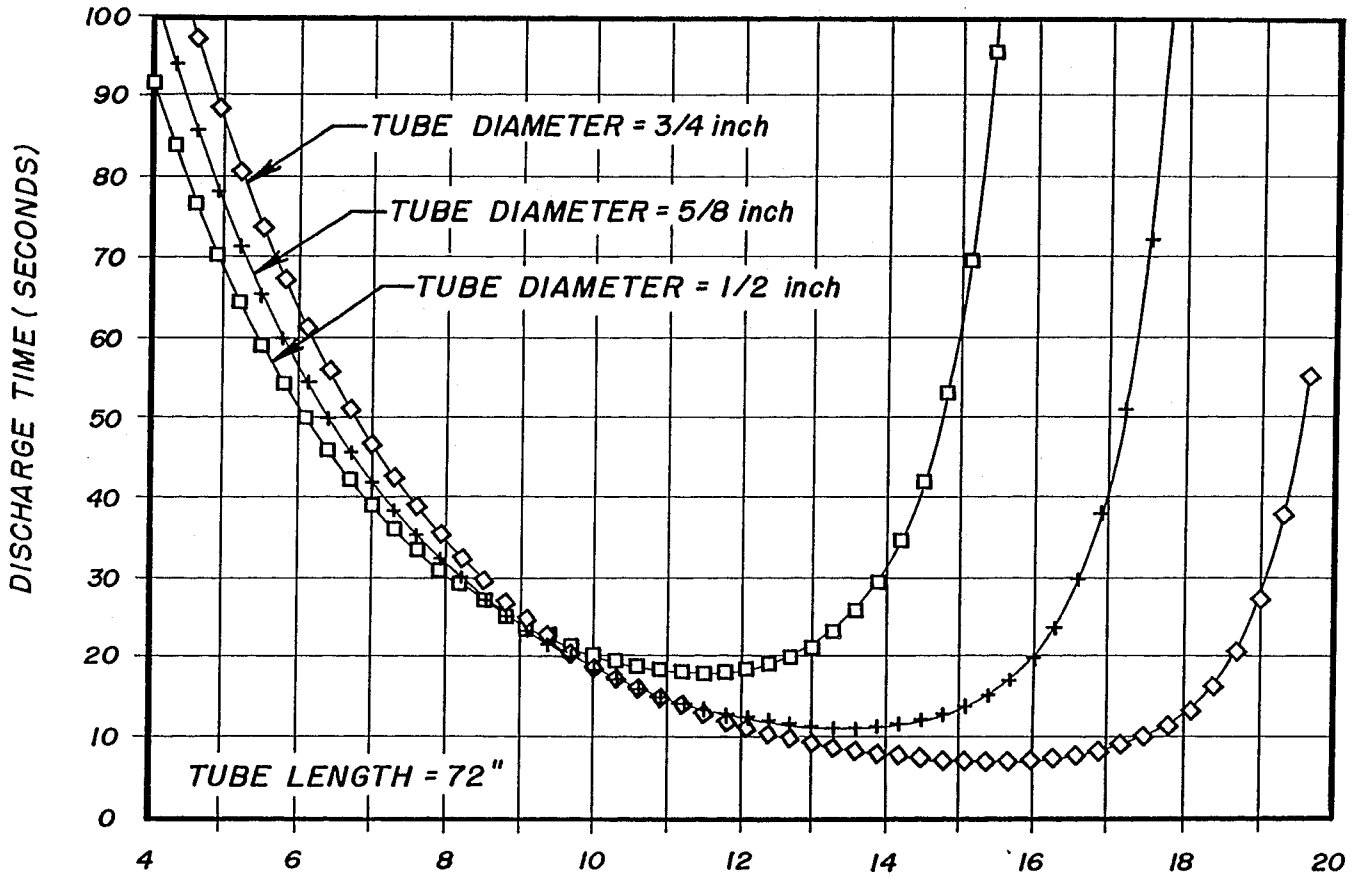

FIGS. 3A to 3C depict model predictions of the effects of varying tube 28 diameter, tube length and flow rate on discharge time. FIG. 3A in particular illustrates the effect of varying tube diameter in a four foot tube, a six foot tube and an eight foot tube under conditions where the gas flow rate is constant at ten cubic feet per minute. As is evident from FIG. 3A, discharge times become longer and thus ion output falls off as a function of tube length. Discharge times below about 20 seconds are most desirable for charge suppression in clean rooms and, as is evident in FIG. 3A, tubes having a length exceeding about six feet do not realize these discharge times irrespective of diameter. It should be recognized that tubes longer than six feet can be used where practical considerations make that necessary. The rate of ion delivery to the point of use falls off as tube length is increased but the reduced ion flow can still provide a significant degree of suppression of static charge build-up.

FIG. 3A also illustrates that the lowest discharge times are realized only if tube diameter is within a particular range which is somewhat dependent on the length of the tube although the ranges overlap in each case depicted in FIG. 3A. In the case of tubes which do not exceed about six feet in length, inside diameters of about 0.6 inch provide the minimum discharge times. While this specific diameter provides optimum performance with such tubes, satisfactory ion flow for some purposes can also be obtained with a range of tube diameters which is dependent on the maximum discharge time that is acceptable for the particular usage.

The sharp decrease in performance as the diameter of a tube of given length is decreased below its optimum range is believed to result from increased ion contact with the tube wall which results in neutralization. The less abrupt fall off in performance as tube diameter is increased above the optimum range is believed to result from increased neutralization by charge exchange between positive and negative ions which itself is caused by the increased dwell time of individual ions within the tube.

FIG. 3B illustrates the discharge time as a function of tube diameter for a six foot long tube using flow rates of 8, 10 and 12 cubic feet per minute. It may be seen that higher flow rates, within this general range of flow rates, provide better performance at the relatively large tube diameters but that a reversed effect occurs at the small tube diameters. This decrease of performance at the smaller tube diameters, as flow rate is increased, is believed to result from wall losses due to high turbulence and sheer stress associated with forcing a large flow through a small tube.

Increasing flow rate beyond a certain point, which is dependent on the diameter for a tube of given length, is also counterproductive at the larger tube diameters as may be seen from FIG. 3C which shows discharge time as a function of flow rate in six foot tubes having inside diameters of ½ inch, ⅝ inch and ¾ inch. The abruptly rising discharge times at high flow rates are believed to arise from increasing wall losses. Discharge times also rise as flow rate is decreased below a certain point as is evident in FIG. 3C, the point being dependent on tube diameter. Thus the data of FIGS. 3B and 3C indicate that there is an optimal flow rate which dependent on tube diameter and length.

Tube length is generally dictated by the arrangement of equipment and working space at the work site but should be minimized to the extent possible and should preferably not exceed about six feet as discussed above. Given a flow delivery tube of the minimum length adaptable to the work site, it may be seen from FIGS. 3A to 3C that the diameter of the tube and the flow rate should be within particular ranges of values if a desirably low discharge time is to be realized. If, for example, 20 seconds is the maximum acceptable discharge time at the work site, then tube diameter should be within the range from about 0.5 inches to about 0.8 inches depending on flow rate and tube length. Flow rate should be within from about 10 cubic feet per minute to about 13 cubic feet per minute. As previously discussed, the tube lengths should not exceed about 6 feet in instances where the optimally low discharge time is to be realized. In many instances, it is desirable to optimize performance by increasing tube diameter, rather than flow rate, to the extent consistent with the data of FIGS. 3A to 3B as the resulting reduction of flow rate realizes economies in gas consumption.

It should be recognized that there are instances where operation somewhat outside the above given ranges of parameters may be in order because of relaxed requirements for electrostatic charge suppression or for other reasons.

Referring again to FIG. 1, the ionizing chamber 19 is in effect an enlargement in the gas flow path 27 at which flow velocity is slowed. This provides for a desirably high concentration of ions in the output flow as each gas molecule is exposed to the X-rays 21 for a long period of time and a large volume of gas is being irradiated at any given time.

Figures 4, 5, 6:
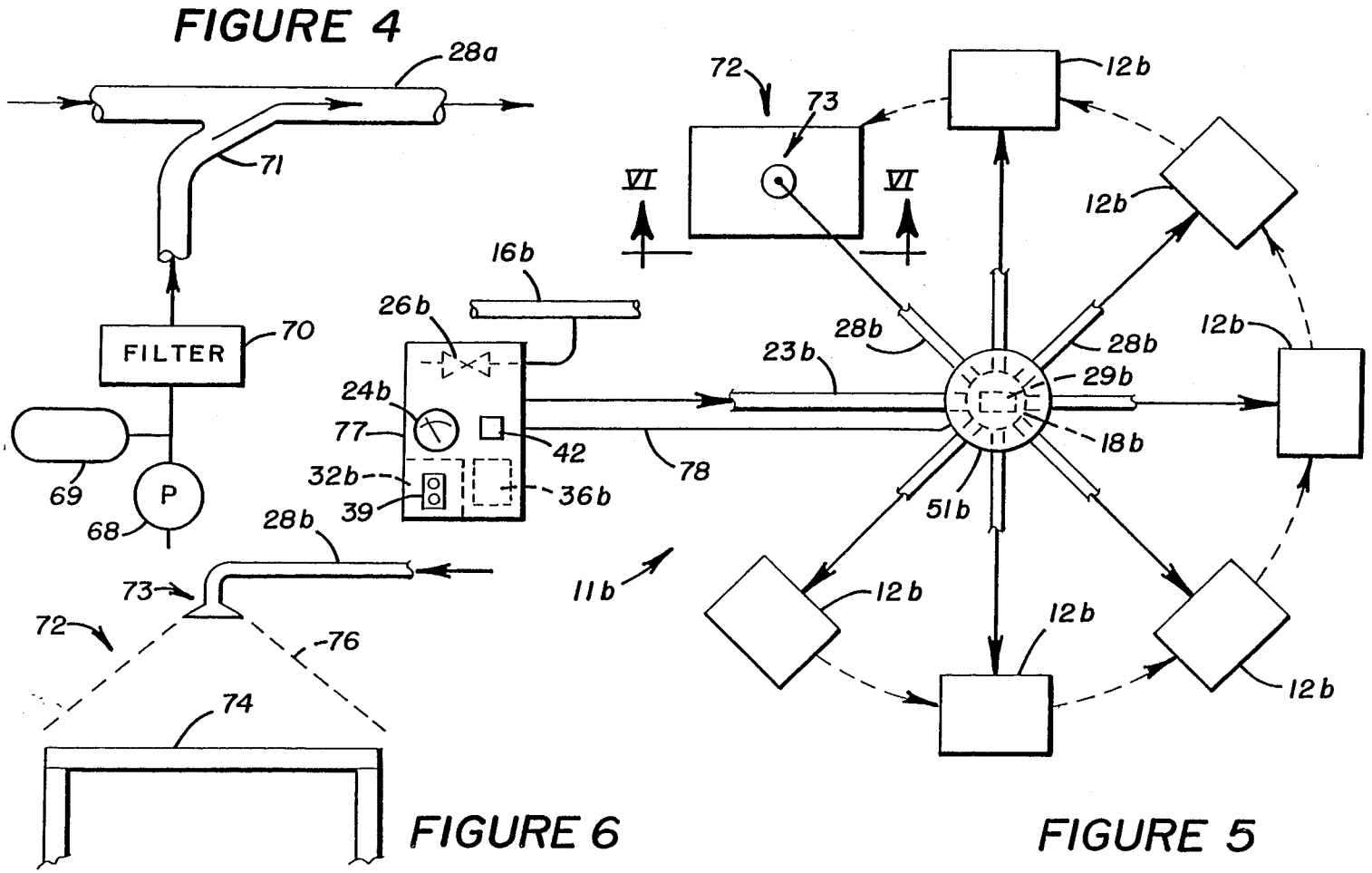
FIG. 4 is a diagrammatic view illustrating a modification of a portion of the structure which can realize operational economies.
FIG. 5 is a perspective view of another embodiment of the invention for suppressing electrostatic charge buildup on objects at a plurality of spaced apart processing stations and which in this example include both isolation boxes and work areas where the products are un-enclosed.
FIG. 6 is an elevation view of a portion of the apparatus of FIG. 5 taken along line VI—VI thereof.

In some installations, a low cost supply of piped in nitrogen or the like may not be available and it may be necessary to rely on costly bottled gas. Referring now to FIG. 4, economies may be realized by adding a flow of compressed air from a pump 68 and accumulator tank 69 or other source to the flow delivery tube **28*a* downstream from the region where ionizing occurs. The air conduit 71 from tank 69 which communicates with the flow delivery tube 28*a* is preferably angled relative to the tube to inject the carrier flow of air in the general direction of the gas flow and also includes a filter 70** to prevent contamination of the ion flow with particulate matter. The air reduces the ion concentration in the combined flows but this can be acceptable under some conditions in view of the savings in gas consumption. Injection of air downstream from the ion generation region does not result in ozone production as the oxygen in the air is not exposed to X-rays.

Referring now to FIG. 5, a single unit of the apparatus **11*b* can be arranged to suppress electrostatic charge within a series of isolation boxes 12*b* and/or at work stations 72 such as an inspection area table 74** where the wafers or other workpieces are in the open rather than being confined in an enclosure.

Given the previously discussed decrease in ion output as the length of the flow delivery tubes **28*b* is increased, it can be advantageous to arrange the isolation boxes 12*b* and other work stations 72 in a circular pattern with the gas ionizing chamber housing 18*b* and shielding enclosure 51*b* being at the center of the circle. This enables servicing of a number of such boxes 12*b* and/or work stations 72 without requiring flow delivery tubes 28*b*** of excessive lengths.

The apparatus **11*b* may be essentially similar to the previously described embodiment except that a plurality of flow delivery tubes 28*b* extend radially from ionizing chamber housing 18*b* and enclosure 51*b* to each connect with a separate one of the isolation boxes 12*b* or work stations 72. Enclosure 51** has a cylindrical configuration in this embodiment to accommodate to this arrangement.

Delivery tubes **28*b* may be communicated with the isolation boxes 12*b* in the manner previously described. In the case of open work stations such as inspection area 72, with reference to FIGS. 5 and 6 in conjunction, the outlet 73 of the flow delivery tube 28*b* may be spaced above the table 74 at which products are inspected in position to release the flow 76** of ionized gas into the region immediately about the table surface.

Referring again to FIG. 5 in particular, the flow control valve **26*b*, flowmeter 24*b* and electrical components such as power supply 32*b*, high voltage generator 36*b*, control switch 39 and indicator lamp 42 may, if desired, be housed in a console 77 which is coupled to the ionizing chamber housing 18 through the gas input conduit 23*b* and which is coupled to the X-ray tube 29*b* through a multiconductor electrical cable 78. The console 77 need not necessarily be in the immediate vicinity of the enclosure 51*b***.

While the invention has been described with respect to certain specific embodiments for purposes of example, many modifications and variations are possible and it is not intended to limit the invention except as defined in the following claims.

We claim:

1. In a method for providing an ionized gas environment at a predetermined region, the steps comprising:
directing a flow of pressurized gas to said region along an enclosed flow path,
ionizing said gas flow by directing ionizing radiation into a predetermined portion of said enclosed flow path at a location therein which is spaced apart from said predetermined region,
suppressing escape of radiation which propagates out of said predetermined portion of said flow path, and
releasing said ionized gas flow from said enclosed flow path at said predetermined region.

2. The method of claim 1 including the further steps of:
expanding said enclosed flow path and slowing said gas flow at said predetermined portion of said flow path and,
contracting said flow path and accelerating said gas flow at the portion of said flow path which extends from said predetermined portion to said predetermined region.

3. The method of claim 1 including the further step of producing ions in said gas flow by directing X-rays into said predetermined portion of said flow path.

4. The method of claim 1 including the further step of maintaining said gas flow substantially oxygen free at least at said predetermined portion thereof.

5. The method of claim 1 including the further steps of:
dividing said gas flow at the downstream end of said predetermined portion thereof, and
directing said divided gas flow to a plurality of predetermined regions within a plurality of enclosed flow paths.

6. The method of claim 5 including the further step of locating said plurality of predetermined regions at a series of spaced apart locations along a curved zone which at least partially encircles said predetermined portion of said flow path.

7. The method of claim 5 including the further step of positioning each of said plurality of predetermined regions substantially equidistantly from said predetermined portion of said flow path.

8. The method of claim 1 including the further step of injecting a second gas flow of dissimilar gas into said enclosed flow path at a location between said predetermined portion thereof and said predetermined region.

9. The method of claim 1 including the further step of maintaining the velocity of said gas flow substantially constant between said predetermined portion of said flow path and said predetermined region.

10. The method of claim 1 including the further steps of:
limiting the length of the portion of said flow path that extends from said predetermined portion to said predetermined region to about six feet,
maintaining the flow rate of said gas flow within the range from about 10 to about 13 cubic feet per minute, and
maintaining the diameter of said gas flow within the range from about 0.5 to about 0.8 inch within said portion of said flow path that extends from said predetermined portion of said flow path to said predetermined region.

11. In a method for suppressing electrostatic charge accumulations by industrial products or the like which are situated at a predetermined region, the steps comprising:
directing a flow of pressurized gas to said product region along an enclosed flow path,
ionizing said gas flow by directing ionizing radiation into a predetermined portion of said enclosed flow path at a location therein which is spaced apart from said product region,
suppressing escape of radiation which propagates out of said predetermined portion of said flow path, and
releasing said ionized gas flow from said enclosed flow path at said product region.

12. Apparatus for providing an ionized gas environment at a predetermined region comprising:
a housing having a chamber therein and having an inlet opening and an outlet opening,
inlet means for transmitting a pressurized gas flow to said inlet opening of said housing,
a source of gas ionizing radiation positioned to direct ionizing radiation into the gas flow within said chamber,
shielding means for absorbing radiation which leaves said chamber, and
a flow delivery tubulation for transmitting said gas flow including ions therein to said predetermined region, said tubulation having one end connected to said outlet opening of said housing.

13. The apparatus of claim 12 wherein said flow delivery tubulation is proportioned to provide a flow path of reduced cross sectional area relative to the cross sectional area of the flow path within said chamber whereby said gas flow travels through said tubulation at a velocity which is higher than the gas flow velocity within said chamber.

14. The apparatus of claim 12 wherein said source of gas ionizing radiation is an X-ray tube positioned to direct X-rays into said gas flow within said chamber.

15. The apparatus of claim 12 further including a source of said pressurized gas connected to said inlet means wherein said source contains gas which is substantially oxygen free.

16. The apparatus of claim 12 wherein said flow delivery tubulation has a length which is less than about six feet and has an inside diameter within the range from about 0.5 inch to about 0.8 inch, further including means for maintaining the gas flow rate through said flow delivery tubulation within the range from about 10 cubic feet per minute to about 13 cubic feet per minute.

17. The apparatus of claim 12 wherein said source of gas ionizing radiation is an X-rays tube positioned to direct X-rays into said gas flow within said chamber, and wherein said shielding means includes a body of X-ray absorbent material surrounding said chamber and said X-ray tube and having a first opening through which said inlet means extends and a second opening through which said flow delivery tubulation extends, said shielding means further including a first curved sleeve formed of radiation absorbent material within which said gas flow travels to said inlet opening of said chamber and a second curved sleeve formed of radiation absorbent material within which said gas flow travels away from said outlet opening of said chamber, said first and second sleeves each having an end adjoining said body of radiation absorbent material, said sleeves having sufficient curvature to intercept X-rays which travel through said inlet and outlet openings.

18. The apparatus of claim 12 wherein said flow delivery tubulation has an inside diameter which is uniform throughout the length of said tubulation except at said one end thereof, and wherein said end of said flow delivery tubulation is coupled to said chamber outlet through a fitting having a flow passage which has the same inside diameter.

19. The apparatus of claim 12 further including means for maintaining a selected gas flow rate through said inlet means.

20. The apparatus of claim 12 wherein said source of gas ionizing radiation is an X-ray tube, further including means for suppressing X-ray generation by said X-ray tube during an absence of said gas flow within said apparatus.

21. The apparatus of claim 20 further including a high voltage generator coupled to said X-ray tube to enable X-ray generation thereby, a source of operating current for said high voltage generator, and wherein said means for detecting an absence of gas flow is a pressure operated electrical switch communicated with the gas flow path of said apparatus and through which said source of operating current is connected to said high voltage generator.

22. The apparatus of claim 12 further including means for injecting an additional flow of pressurized gas into said flow delivery tubulation at a location which is downstream from said outlet opening of said housing.

23. The apparatus of claim 12 wherein said inlet and outlet openings are at opposite sides of said chamber with said inlet opening being closer to one end of said chamber than said outlet opening and said outlet opening being closer to the opposite end of said chamber than said inlet opening, and wherein said source of gas ionizing radiation is positioned to direct said radiation into said chamber through one of said ends thereof.

24. The apparatus of claim 12 further including a plurality of said flow delivery tubulations for delivering separate portions of said gas flow to separate locations, each of said flow delivery tubulations having one end communicated with said chamber.

25. The apparatus of claim 24 wherein each of said plurality of flow delivery tubulations extends to a separate one of a plurality of locations which are spaced apart along a curved zone that at least partially encircles the region of said chamber.

26. The apparatus of claim 24 wherein said locations are substantially equidistant from said chamber.

27. The apparatus of claim 12 further including a filter for removing particulate matter from said gas flow, said filter being located at a point in said gas flow that is upstream from the region at which ions are generated in said gas flow.

28. The apparatus of claim 12 further including a vented box for receiving industrial products which are to be protected from electrostatic change build-up by said ionized gas, and wherein the other end of said flow delivery tubulation is communicated with the interior of said box.

29. The apparatus of claim 12 further including a source of said pressurized gas connected to said inlet means wherein said gas source contains substantially oxygen free nitrogen.

* * * * *